US007002104B2

(12) United States Patent
Gilligan et al.

(10) Patent No.: US 7,002,104 B2
(45) Date of Patent: Feb. 21, 2006

(54) HEATED BASEBALL GLOVE/MITT AND METHOD OF HEATING A BASEBALL BAT HANDLE

(75) Inventors: Lawrence J. Gilligan, Ringwood, NJ (US); Joseph Gilligan, IV, Ringwood, NJ (US)

(73) Assignee: Akadema, Inc., Garfield, NJ (US)

( * ) Notice: Subject to any disclaimer, the term of this patent is extended or adjusted under 35 U.S.C. 154(b) by 0 days.

(21) Appl. No.: 10/760,980

(22) Filed: Jan. 20, 2004

(65) Prior Publication Data

US 2005/0155961 A1 Jul. 21, 2005

(51) Int. Cl.
*H05B 1/00* (2006.01)

(52) U.S. Cl. ..... 219/211

(58) Field of Classification Search ..... 219/211
See application file for complete search history.

(56) References Cited

U.S. PATENT DOCUMENTS

| | | | | | |
|---|---|---|---|---|---|
| 3,569,666 | A | | 3/1971 | Murphy et al. | 219/211 |
| 3,621,191 | A | | 11/1971 | Cornwell | 219/211 |
| 3,632,966 | A | | 1/1972 | Arron | 219/211 |
| 3,781,514 | A | | 12/1973 | Olson et al. | 219/211 |
| 3,869,594 | A | | 3/1975 | Shively | 219/211 |
| 4,087,675 | A | | 5/1978 | Sansonetti | 219/211 |
| 4,201,218 | A | | 5/1980 | Feldman et al. | 128/402 |
| 4,513,450 | A | * | 4/1985 | Aoki | 2/19 |
| 4,535,482 | A | | 8/1985 | Spector et al. | 2/160 |
| 4,543,671 | A | | 10/1985 | Monk | 2/158 |
| 4,651,350 | A | | 3/1987 | Dawiedczyk | 2/158 |
| 4,742,579 | A | | 5/1988 | Dunford | 2/160 |
| 4,759,084 | A | | 7/1988 | Madnick et al. | 2/158 |
| 4,764,665 | A | * | 8/1988 | Orban et al. | 219/549 |
| 4,825,039 | A | | 4/1989 | Yoo | 219/212 |
| 4,948,951 | A | | 8/1990 | Balzano | 219/528 |
| 4,950,868 | A | * | 8/1990 | Moss et al. | 219/211 |
| 4,987,783 | A | | 1/1991 | D'Antonio et al. | 73/862.64 |
| 5,032,705 | A | * | 7/1991 | Batcheller et al. | 219/211 |
| 5,035,003 | A | | 7/1991 | Rinehart | 2/159 |
| 5,070,223 | A | | 12/1991 | Colasante | 219/10.55 M |
| 5,187,814 | A | | 2/1993 | Gold | 2/160 |
| 5,369,807 | A | | 12/1994 | Cho et al. | 2/159 |
| 5,459,880 | A | | 10/1995 | Sakaki et al. | 2/168 |
| 5,509,143 | A | | 4/1996 | Yates et al. | 2/160 |

(Continued)

*Primary Examiner*—Thor S. Campbell
(74) *Attorney, Agent, or Firm*—Kaplan Gilman Gibson & Dernier LLP; Michael R. Gilman

(57) ABSTRACT

A heated baseball glove/mitt is provided. In one embodiment the heated glove/mitt comprises front and back shells joined together along select portions of their edges in such manner as to form a finger portion and a thumb portion of the glove/mitt, and further defining an opening between the front and back shells for receiving a hand of a user of the glove/mitt, a web-type panel disposed partially between the finger portion and the thumb portion, at least one interior member located between an inner surface of the front shell and an inner surface of the back shell, at least one finger stall extending from the interior member between the interior member and the back shell having a top surface proximate the inner surface of the back shell, and an electrically conductive member attached along at least a portion of the top surface of the at least one finger stall between the top surface of the at least one finger stall and the inner surface of said back shell for heating the at least one finger stall. In accordance with another aspect of the invention, a method of heating a baseball bat is disclosed.

25 Claims, 8 Drawing Sheets

U.S. PATENT DOCUMENTS

| | | | | |
|---|---|---|---|---|
| 5,541,388 | A | 7/1996 | Gadd | 219/211 |
| 5,589,639 | A | 12/1996 | D'Antonio et al. | 73/724 |
| 5,617,583 | A | 4/1997 | Yates et al. | 2/160 |
| 5,620,621 | A | 4/1997 | Sontag | 219/211 |
| 5,648,063 | A | 7/1997 | Gries et al. | 424/9.363 |
| 5,774,894 | A | 7/1998 | Yates et al. | 2/158 |
| 5,777,296 | A | 7/1998 | Bell | 219/211 |
| 6,055,670 | A | 5/2000 | Parker | 2/161.1 |
| 6,060,693 | A | 5/2000 | Brown | 219/211 |
| 6,141,805 | A | 11/2000 | Fisher-Cohen et al. | 5/420 |
| 6,229,132 | B1 | 5/2001 | Knetter | 219/759 |
| 6,239,410 | B1 | 5/2001 | Tackore | 219/211 |
| 6,268,595 | B1 | 7/2001 | Haenel | 219/528 |
| 6,281,594 | B1 | 8/2001 | Sarich | 290/1 R |
| 6,320,161 | B1 | 11/2001 | Hansen, Jr. | 219/211 |
| 6,389,681 | B1 | 5/2002 | Rock et al. | 29/611 |
| 6,548,789 | B1 | 4/2003 | Rock et al. | 219/548 |
| 6,563,094 | B1 | 5/2003 | Kochman et al. | 219/549 |

* cited by examiner

HEATED BASEBALL GLOVE/MITT AND METHOD OF HEATING A BASEBALL BAT HANDLE

BACKGROUND OF THE INVENTION

This invention relates to the fields of baseball fielding gloves/mitts and a method of heating a baseball bat handle during cold weather. When used throughout the remainder of this application, including, but not limited to, in the claims section, "baseball" shall mean both and/or either, the games of baseball or softball.

Baseball fielding gloves are as old as the game itself. Yet many improvements have been made in baseball gloves over these many years as the game itself has become both quicker and harder to play due to technological advances in the construction of both baseballs and baseball bats, and also due to the higher level of fitness, strength and size of today's baseball players. In order to keep up with these subtle, yet ever present changes in the way the game is played, baseball gloves have also needed to evolve.

Along these same lines, it is now also regularly found that kids to adults are playing baseball more and more, including in weather and climates not normally thought to be ideal for the game. For example, it is not uncommon for the weather during Spring training for the professional leagues, and during the professional league's baseball playoffs and World Series to be quite cold. Further, as is often the case when dealing with popular sports, if the professionals are doing something, the colleges, high schools, elementary schools and parents/children will be trying to imitate the professionals. Hence, it is also not uncommon in today's society for children ranging in all ages and for adults to be playing baseball in cold to very cold weather conditions. It would therefore be desirable to have a baseball glove that keeps a player's hands/fingers warm while playing during these cold conditions, as well as a method of keeping the often times very cold baseball bat handle warm.

Over the years, it has been known to heat various types of clothing items, including but not limited to, general activity, play and dress gloves, but no such heating mechanisms are known to exist for baseball fielding gloves/mitts, and no methods of heating a baseball bat are known. Accordingly, it would be desirable to provide baseball gloves/mitts with heating elements in order to keep a player's hands warm in the colder weather, and it would be desirable to also provide a method for heating the handle of a baseball bat.

SUMMARY OF THE INVENTION

In accordance with one part of the invention, a heated baseball glove/mitt is provided. The heated glove/mitt comprises front and back shells joined together along select portions of their edges in such manner as to form a finger portion and a thumb portion of the glove/mitt, and further defining an opening between the front and back shells for receiving a hand of a user of the glove/mitt, a web-type panel disposed partially between the finger portion and the thumb portion, at least one interior member located between an inner surface of the front shell and an inner surface of the back shell, at least one finger stall extending from the interior member between the interior member and the back shell having a top surface proximate the inner surface of the back shell, and an electrically conductive member attached along at least a portion of the top surface of the at least one finger stall between the top surface of the at least one finger stall and the inner surface of said back shell for heating the at least one finger stall. In accordance with another aspect of the invention, a method of heating a baseball bat is disclosed.

Accordingly, it is an object of the invention to provide an improved baseball glove/mitt.

Still another object of the invention is to provide an improved baseball glove/mitt that is heated.

Yet another object of the invention is to provide a method of heating a baseball bat.

Still another object of the invention is to provide, in combination, a method of warming a player's fielding glove hand while he/she is in his/her fielding position, and of warming a baseball bat when the player is in his/her hitting position.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
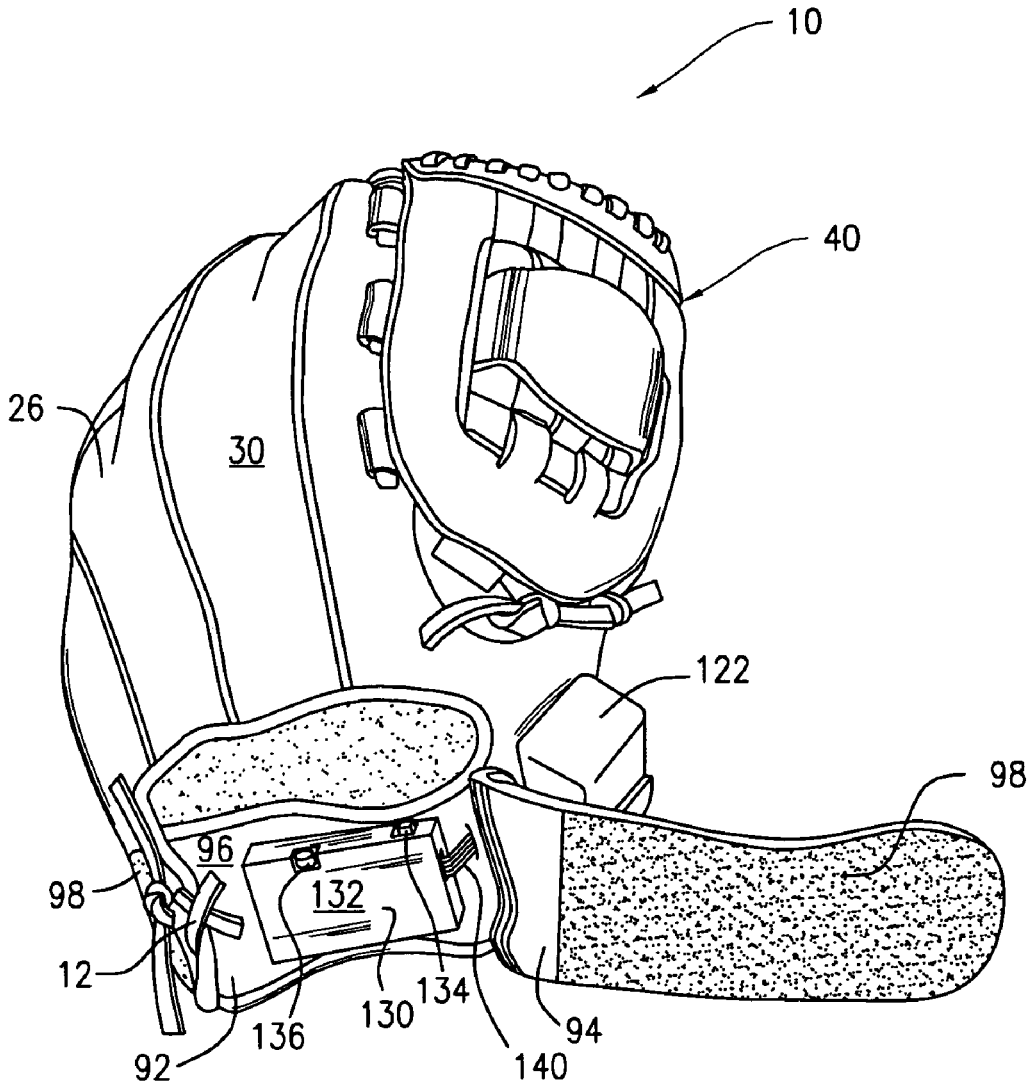
FIG. 1 is a rear prospective view of a first embodiment of a baseball fielding glove/mitt of the subject invention.
Figure 4:
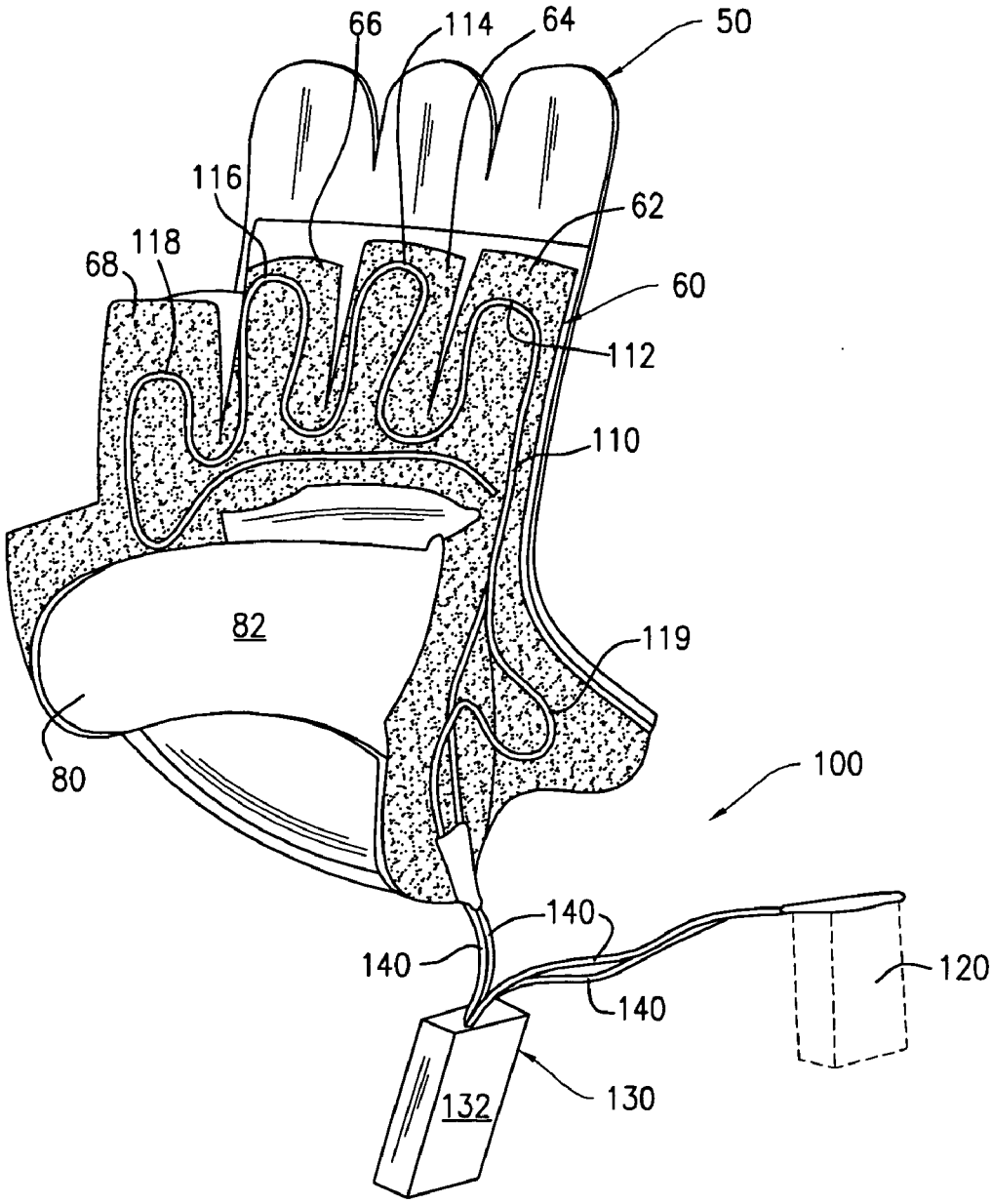
FIG. 4 is a rear prospective view of an interior member and finger stalls and electrically conductive member of the baseball fielding glove/mitt of FIGS. 1–3.
Figure 5:
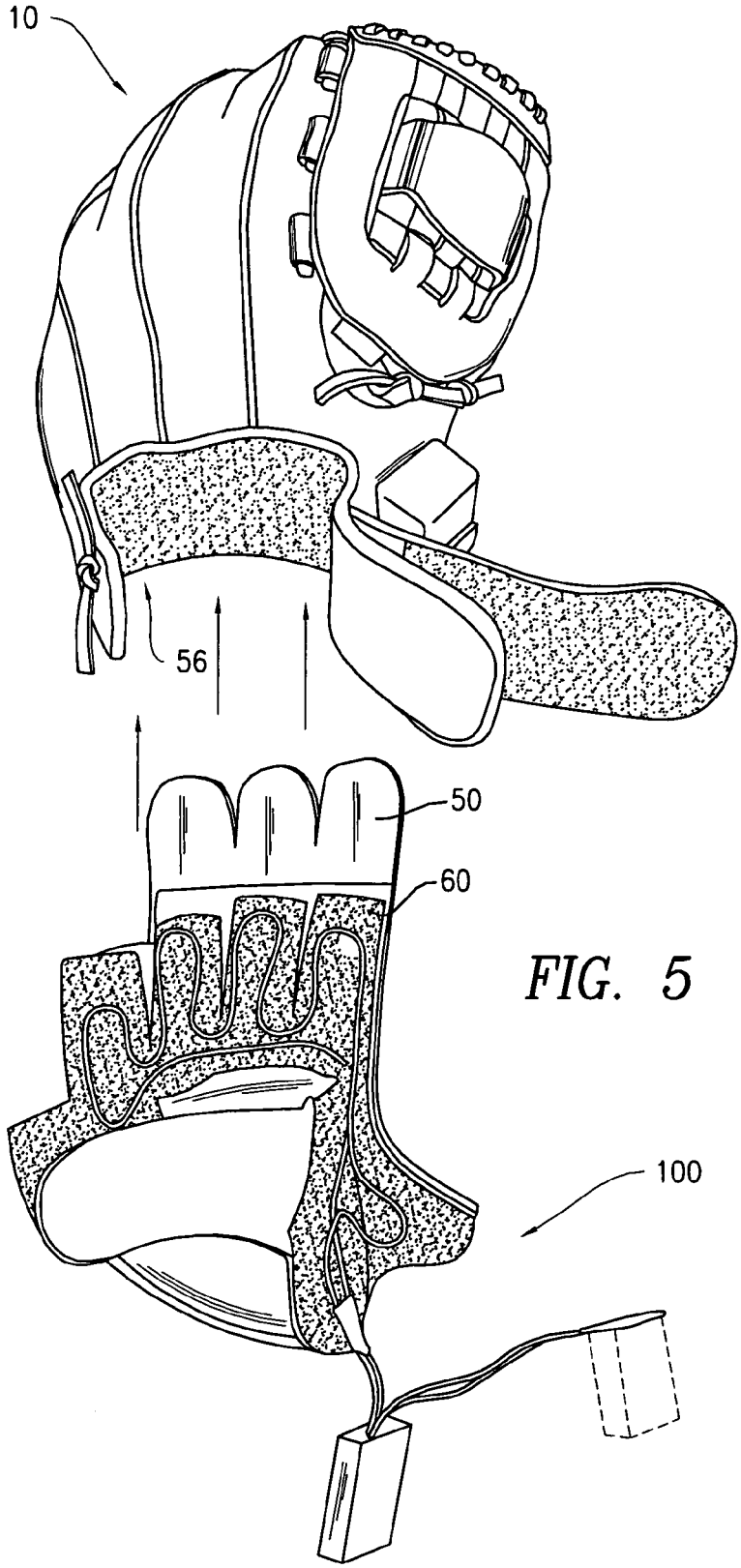
FIG. 5 is an exploded prospective view showing how the interior member is positioned within the baseball fielding glove/mitt.
Figure 6:
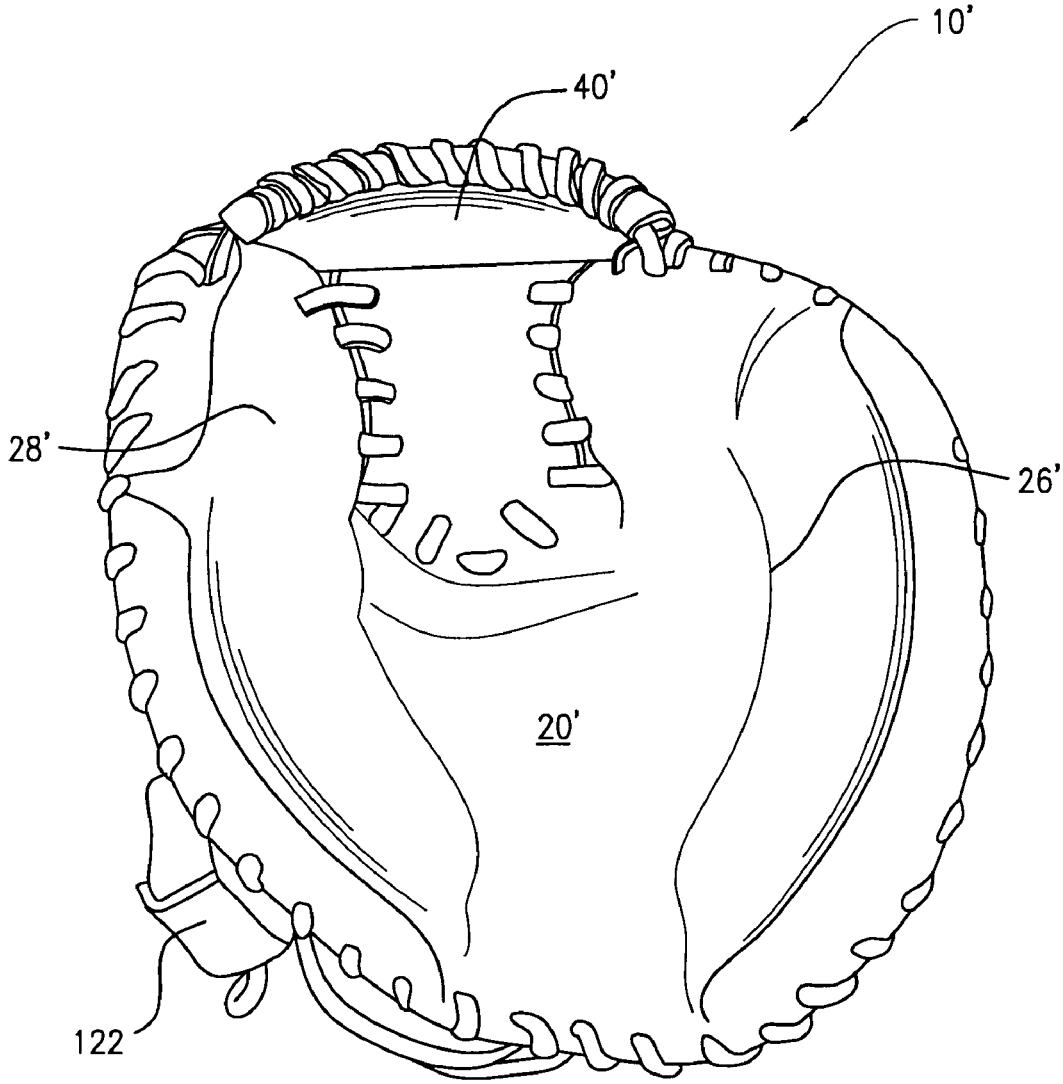
FIG. 6 is a front elevational view of another type of baseball fielding glove/mitt which can be used in association with the invention.

Referring to the figures, a baseball fielding glove constructed in accordance with the invention having an electrically conductive member for heating portions of the interior of the glove, is shown in FIGS. 1–6. FIGS. 2A and 2B show a slightly different embodiment for the wrist strap of the glove of FIG. 1, and FIG. 6 shows a catcher's mitt, as opposed to a fielder's glove. As used hereinafter, "glove" and "mitt" may be used interchangeably.

As seen in FIGS. 1–6, a baseball fielding glove is shown at 10. Glove 10 has a front shell 20 for fielding a baseball (see FIG. 3) and a back shell 30. When joined together along their respective edges and at select interior portions thereof, front and back shells 20 and 30 form finger portion 26 and thumb portion 28. A web-type panel known to baseball gloves/mitts, and shown at 40, is disposed partially between finger portions 26 and thumb portion 28, as is known in the art. It is anticipated herein that any known manner of forming the web-type portion of the glove/mitt is covered herein, and so the particular construction of the web-type panel 40 and/or for that matter of the general exterior of glove 10, will not be discussed. It being understood that any form of glove 10, finger portion 26, thumb portion 28 and/or web-type panel 40 are anticipated by the invention. In this regard, and directing attention to FIG. 6, baseball catcher's mitt 10' is shown. Mitt 10' has a finger portion 26', a thumb portion 28' and a web-type panel 40', along with a front shell 20' and a back shell (not shown). It is to be further understood herein that apart from slight configuration modifications, the electrically conducting member to be discussed hereinafter with respect to FIGS. 4 and 5 for glove 10, will be essentially the same for mitt 10'.

Continuing now with the discussion of FIGS. 1–5, and in particular FIGS. 4 and 5, electrically conductive member 100 is seen extending along finger stall assembly 60. In particular, an interior member 50 is shown to form a shape which will easily be able to be received within opening 56 (see FIG. 5) at the bottom/heel portion of glove/mitt 10. As is known in the art of baseball glove/mitt manufacturing, interior member 50 is not actually inserted into the interior part of glove 10 after front and back portions 20 and 30 are already joined together, but instead, is usually attached between shells 20 and 30 during the process of attaching together shells 20 and 30 during the normal glove construction process. Accordingly, FIG. 5 is not meant to indicate how/when interior member 50 is inserted within glove 10, but is simply used to illustrate an exploded view of glove 10 and thereby assist in the orientation of member 50 within glove 10.

Continuing with FIG. 4, member 50 will normally be attached against the inner surface of front shell 20, as, in its most basic form, member 50 is a padding member used to cushion the impact of when a baseball is fielded against the fielding surface of front shell 20. In this way, it is seen that on the back of member 50 there is attached finger stall assembly 60, into which a hand of the baseball player will ultimately be received when glove 10 is completed. In the preferred embodiment, finger stall assembly 60 is comprised of index, middle, ring and pinky finger stalls 62, 64, 66 and 68, respectively. Finger stall assembly 60 is preferably attached to member 50 using known-in-the-art stitching methods.

In a preferred embodiment, finger stall assembly 60 has extending therefrom a wrist contact member 80, which has on an interior portion thereof (not shown), a fur-type material for contacting the back of the player's hand. As is known in the art, member 80 would be stitched in the normal manner to glove 10's strap assembly 90, which will be discussed in more detail below.

Electrically conductive member 100 comprises a resistance wire element 110, a battery 120, a control box 130 having an on/off switch 134 and an on/off indicator light 136, and wires 140 for connecting battery 120 to control box 130 and also for connecting control box 130 to resistance wire 110. Resistance wire 110 is attached along a top surface of finger stall assembly 60 in any manner deemed appropriate to best achieve heating of finger stall 60 when electrically conductive member 100 is turned on. As shown in the figures, resistance wire 110 has, in a preferred embodiment, loop elements 112, 114, 116, 118 and another at 119. As is obvious from FIG. 4, loops 112–118 are meant to essentially mimic the shape of a person's four fingers, so as to insure warming of those fingers of the player's hand when received within finger stalls 62, 64, 66 and 68 of finger stall assembly 60. In addition, loop 119 is for insuring that some warmth is also transmitted to the player's thumb, which would be found within thumb portion 28.

It is to be understood that while the above described preferred embodiment for the shape of resistance wire 110 may be in the form of loops 112–119, any other configurable shape of resistance wire 110 is anticipated herein; even a simple straight wire across all four, or only some, of the player's fingers, possibly located across the knuckles of the player's hand (not shown).

Viewing now the various drawings showing the exterior of glove 10 in association with the above description of how member 50 is placed within glove/mitt 10, placement of battery 120 and control panel 130 is constructionally self evident. In particular, as is best seen in FIG. 1, battery 120 is received within battery compartment 122, while control panel 130 is seen to be secured along strap assembly 90. As is also seen in the figures, where wires 140 need to extend through any part of the elements of glove/mitt 10, whether it be strap assembly 90 or back shell 30, holes are located in glove/mitt 10 for receipt therethrough of wires 140.

Continuing with the discussion of electrically conductive member 100, control panel 130 is secured to strap assembly 90 in any manner known in the art, including the use of adhesive, Velcro ®, or other known manners. The preferred manner would be through the use of Velcro ® as this would allow for easier removal and reattachment than if adhesive were used. In a similar manner, battery case 122 is secured to back shell 30 of glove/mitt 10. Battery compartment 122 also has an openable flap for allowing battery 120 to be removed for replacement and/or charging. In the embodiment of the figures, battery 120 is shown to be a nine volt battery, but the invention anticipates the use of any type of standard dry cell battery.

Directing attention now to the various manners of construction of strap assembly 90, it is shown in FIG. 1 that strap assembly 90 has first and second strap elements 92 and 94. Element 92 is the continuing part of back shell 30 on the side of battery compartment 122, and is secured via lacing 12 on the other side. Element 92 has an outside surface 96 onto which control panel 130 is secured through one of the above discussed manners. In order to protect control panel 130, strap assembly 90 has second element 94, which element is secured to back shell 30 between battery compartment 122 and control panel 130, and has Velcro ® attachment means 98 at an end thereof. Another opposite portion of back shell 30 has the opposing mating elements of Velcro ® 98 secured thereto and strap element 94 is secured over control panel 130 in such manner. It is also anticipated through this construction that by adjusting where Velcro ® 98 is adhered along back shell 30 that strap assembly 90 might be made tighter around a players wrist.

As was also discussed earlier regarding member 80 of finger stall member 60, outside surface 82 of member 80 is stitched (or otherwise secured) to an inside surface (not shown) of strap element 92 opposite outside surface 96.

Figure 2A:
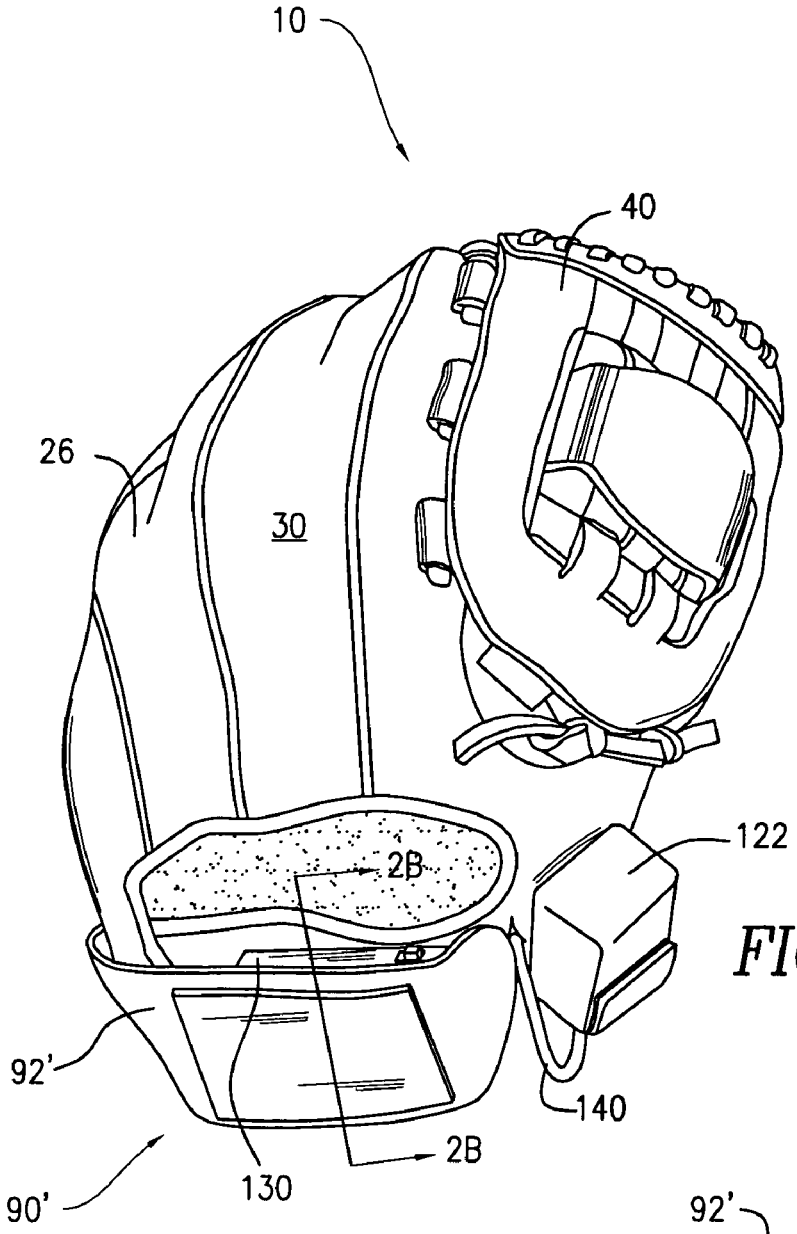
FIG. 2A is a rear prospective view of another embodiment of a baseball fielding glove/mitt of the subject invention.
Figure 2B:
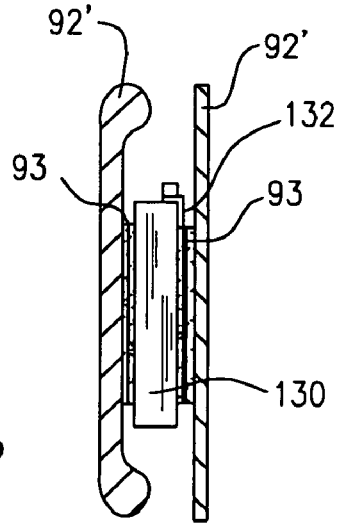
FIG. 2B is a cross-sectional view taken along line 2B—2B of FIG. 2A.
Figure 3:
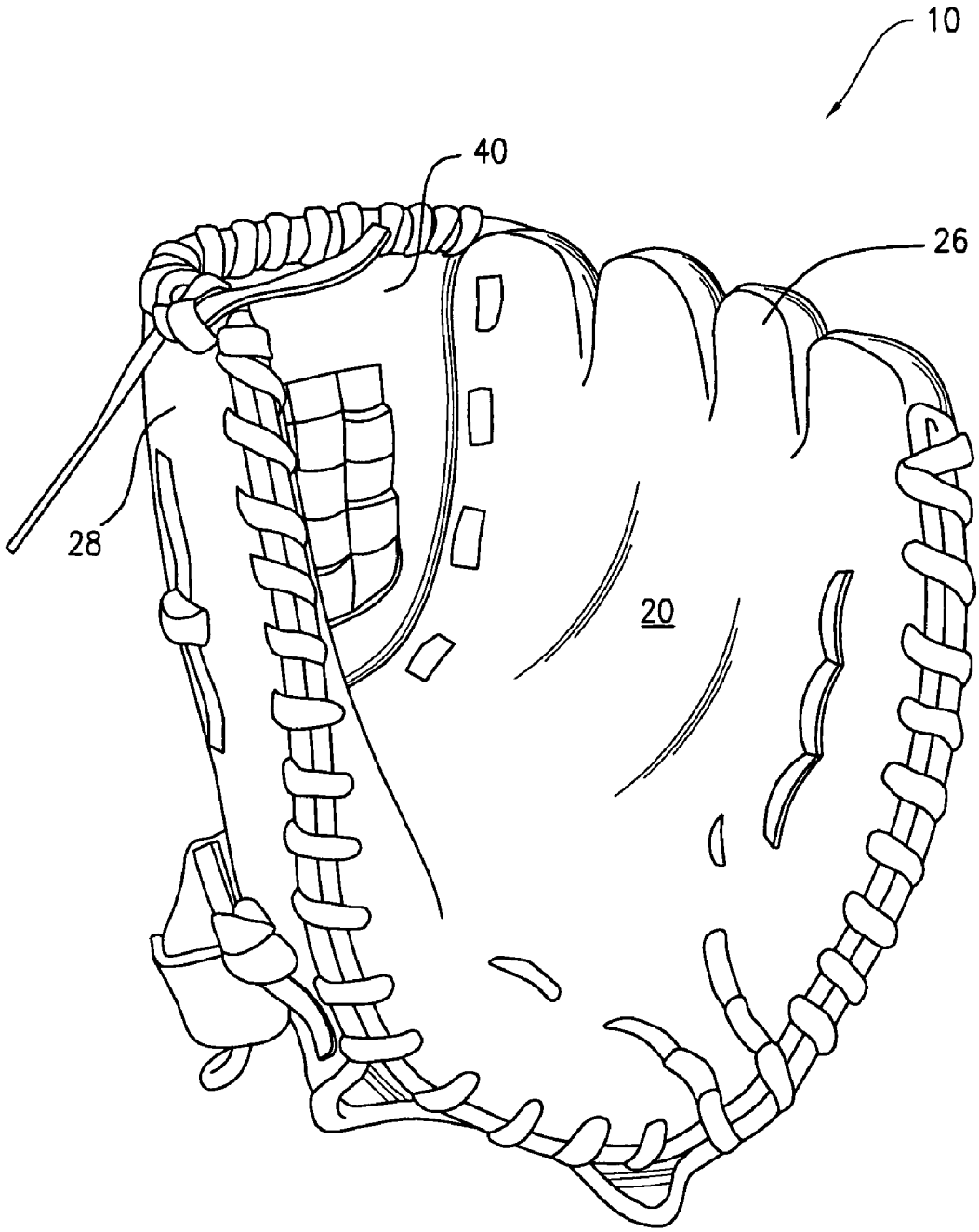
FIG. 3 is a front prospective view of the baseball fielding glove/mitt of FIGS. 1 and 2.

Turning to a second embodiment of glove/mitt 10, shown in FIGS. 2A and B, strap assembly 90' is comprised of a single strap element 92' which extends from back shell 30 through a slot (not shown) in back shell 30 to wrap back upon itself for closure of strap assembly 90'. In particular, as seen in FIG. 2A, back shell 30 extends downward past battery compartment 122 and then extends in a continuous manner to form strap element 92'. On the opposite side of the bottom portion of back shell 30 (away from battery compartment 122), the slot is formed through shell 30. Strap element 92' is received through the slot from an inside position through, to an outside position of shell 30 and is then doubled-back over itself in the direction of battery compartment 122 to be secured by Velcro ® 93 to either back shell 30 and/or onto outside surface 132 of control panel 130, as is best seen in FIG. 2B. As with the embodiment shown in FIG. 1, by pulling strap element 92' in this case, more towards battery compartment 122, strap assembly 90' is tightening around the wrist of the player.

Figure 7A:
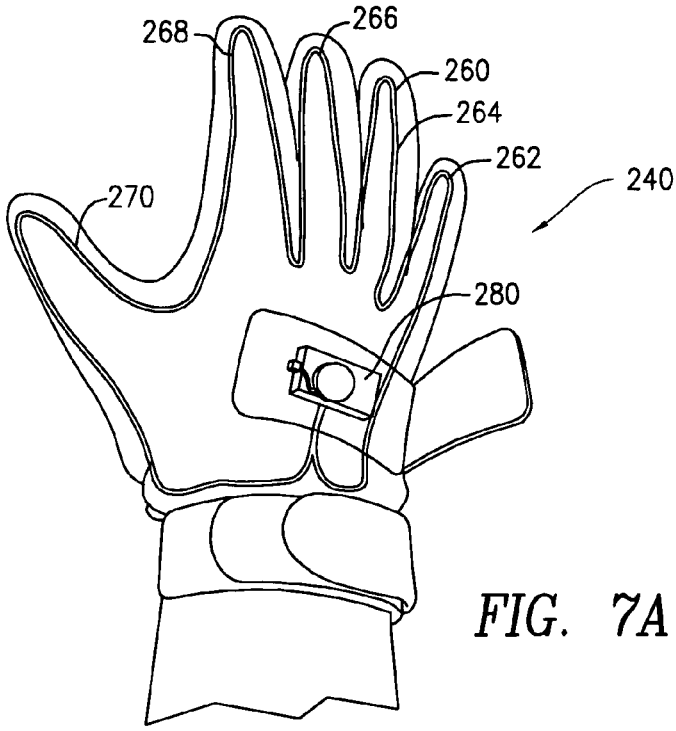
FIG. 7A is a rear prospective view of a baseball batting glove to be worn on the hand of a baseball player having an electronically conductive member.
Figure 7B:
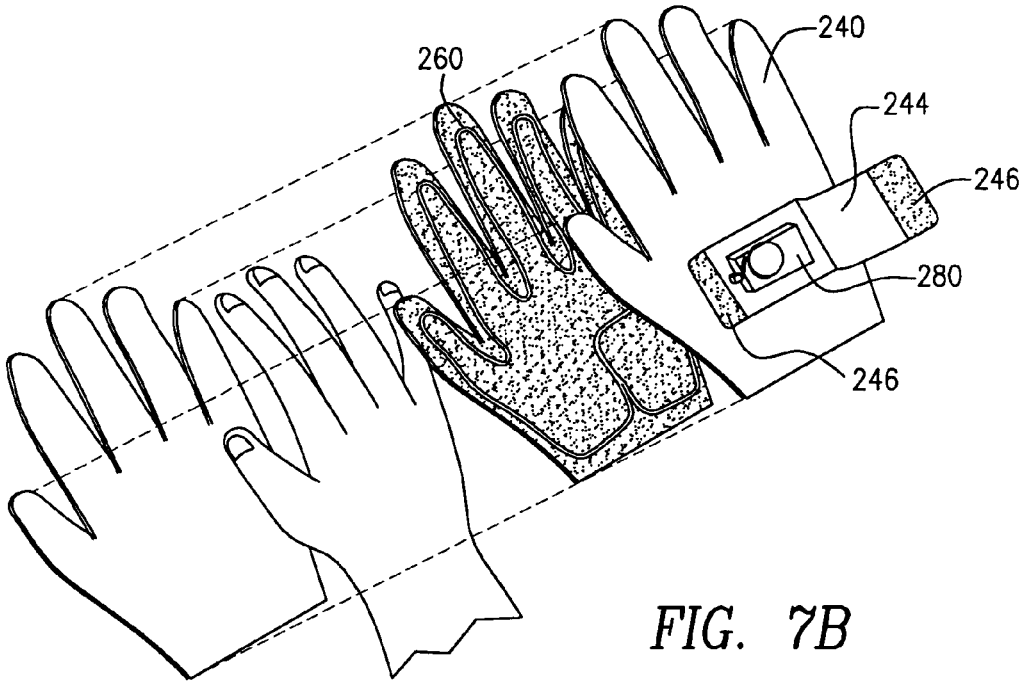
FIG. 7B is an exploded view of FIG. 7A.
Figure 8:
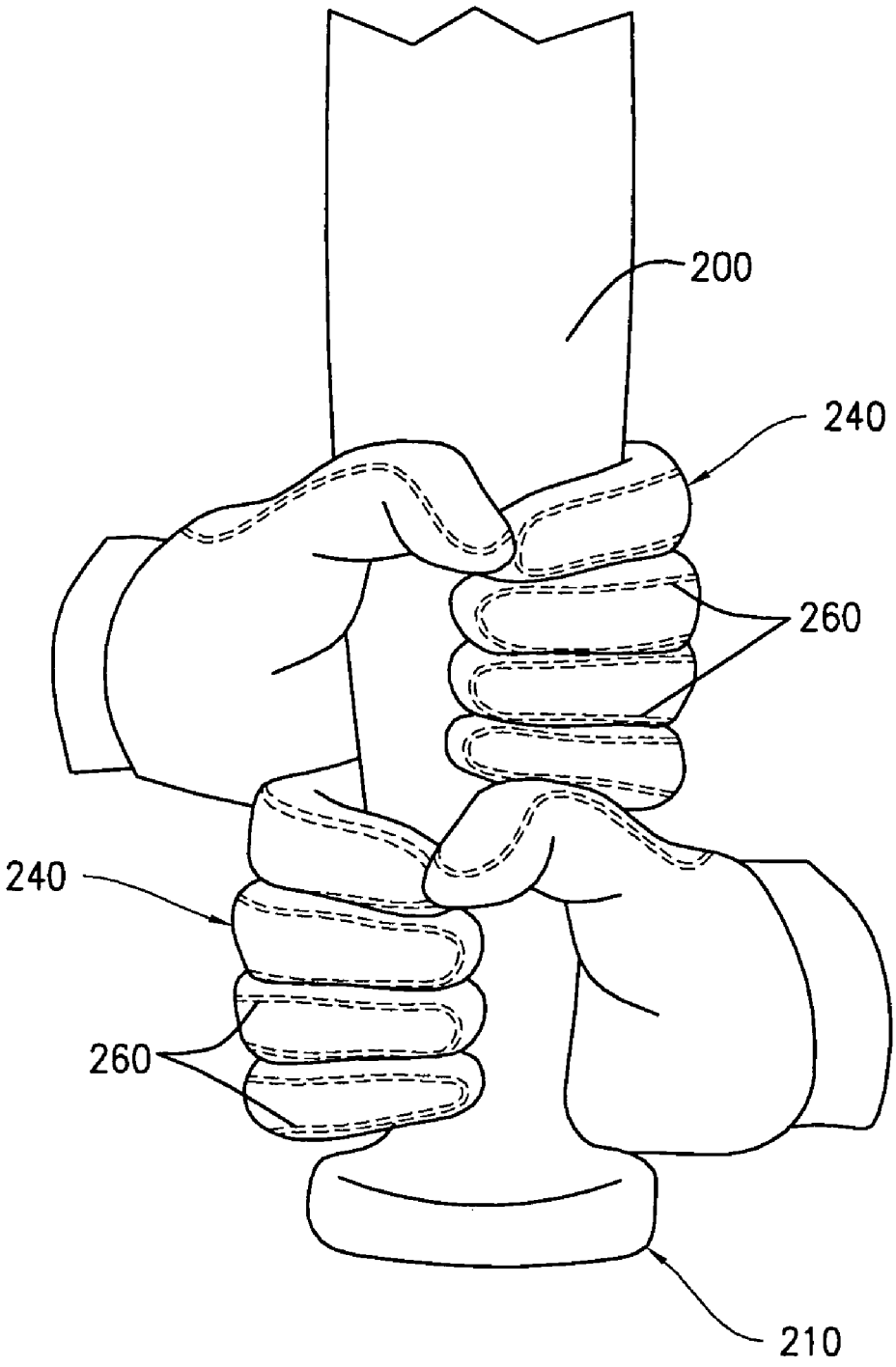
FIG. 8 is a prospective view of the hands of a baseball player gripping a baseball bat with the glove of FIG. 7 on at least one hand.

Turning now to a discussion of FIGS. 7 and 8, it is seen that in order to warm a handle 200 of a baseball bat 210 a player will wear one or two heated batting gloves 240. Heated batting gloves 240 also have electrically conductive members, shown at 260. Electrically conductive member 260 operates in substantially the same manner as electrically conductive member 100 of FIGS. 1–6, meaning, in particular, that in a preferred embodiment they have loop elements 262–270 which essentially take on the form and shape of a players hand, for overall heating of the players hand within the glove. Combined battery and control panel 280 is found on the back of glove 240 so that when glove 240 is worn control panel/battery 280 is not obstructive. As with the gloves/mitts of FIGS. 1–6, a protective/concealing element 244 exists for the embodiment of FIGS. 7–8, which is also adhered by Velcro ® 246 to the top, back surface of glove 240.

In operation, a player will put on at least one heated batting glove 240 prior to approaching either the on deck circle or the batter's box. He/she will pick up his/her bat using the at least one heated glove and will proceed to bat in the regular course of playing the game by gripping the bat while wearing the heated glove 240, so as to insure that the cold handle 200 of bat 210 stays warm during this important and vital part of the game.

Unless otherwise expressly indicated, when used throughout this document the term "substantially" shall have the meaning of "approximation", not "magnitude"; i.e., it shall have the meaning, "being largely but not wholly that which is specified." See, *Webster's Ninth New Collegiate Dictionary*, Merriam-Webster Inc., 1989. Hence, applicant is not using the term "substantially" to denote "considerable quantity" or "significantly large," but is instead using the term as a qualifier/minimizer of a term. For example, in the fictitious phrase "the head portion is substantially above the body portion," "substantially above" is meant to indicate that while most of the head portion can be located above the body portion, there is certainly at least some of the head portion located in planes with the body portion, or even below parts of the body portion. As a further example, as used in the fictitious phrase "substantially hollow," "substantially" is meant to indicate that there are areas where the item is not hollow, without regard to a quantity of hollow verses non-hollow areas. These examples are meant to be illustrative of the meaning to be attributed to the term "substantially" as used throughout this document, even if these particular phrases are not found herein.

It will thus be seen that the objects set forth above, among those made apparent from the preceding description, are efficiently attained, and since certain changes maybe made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A baseball glove/mitt, comprising:

a front shell for fielding a baseball thereon having an edge;

a back shell having an edge and being joined to said front shell along select portions of said edges in such manner as to form a finger portion and a thumb portion of said glove/mitt, and further defining an opening between said front and back shells for receiving therethrough a hand of a user of said glove;

a web-type panel disposed partially between said finger portion and said thumb portion;

at least one interior member located between an inner surface of said front shell and an inner surface of said back shell;

at least one finger stall extending from said interior member, between said interior member and said back shell, having a top surface proximate said inner surface of said back shell; and an electrically conductive member extending along at least a portion of said top surface of said at least one finger stall between said top surface of said at least one finger stall and said inner surface of said back shell for heating said at least one finger stall.

2. A baseball glove/mitt as recited in claim 1, wherein said front and back shells are substantially joined along select peripheral sections of said front and back shells.

3. A baseball glove/mitt as recited in claim 2, wherein said front and back shells are further substantially joined through select intermediary sections of said front and back shells.

4. A baseball glove/mitt as recited in claim 1, further comprising a power source attached to an outer surface of said back shell.

5. A baseball glove/mitt as recited in claim 4, said power source comprising a battery.

6. A baseball glove/mitt as recited in claim 5, said battery being selectively, removably secured to said outer surface of said back shell in a selectively openable compartment.

7. A baseball glove/mitt as recited in claim 4, said back shell further comprising a strap located proximate said hand receiving opening.

8. A baseball glove/mitt as recited in claim 7, said strap comprising first and second portions having inner and outer surfaces, said inner surface of said first portion closest to said user's hand when said hand is within said opening and said outer surface of said first portion proximate said inner surface of said second portion when said second portion is in a closed position.

9. A baseball glove/mitt as recited in claim 8, further comprising an on/off switch mechanism for said electrically conductive member attached between said electrically conductive member and said power source.

10. A baseball glove/mitt as recited in claim 9, said on/off switch mechanism attached to said glove/mitt between said first and second portions of said strap.

11. A baseball glove/mitt as recited in claim 10, wherein a first end of said second portion of said strap is pivotally secured to a portion of said outer surface of said back shell and a second end of said second portion of said strap is releasably securable to another portion of said outer surface of said back shell for easy accessibility to said on/off switch mechanism.

12. A baseball glove/mitt as recited in claim 10, wherein said first and second portions of said strap are a single, unitary length of strap, a first end thereof fixedly attached to said back shell at a first portion of said back shell located on a first side of said opening and a second end thereof received through a receptacle located at a second portion of said back shell on a second, opposite side of said opening, said second end of said unitary length of strap being releasably securable at said first portion of said back shell.

13. A baseball catching glove/mitt used for fielding a baseball comprising:

an outside shell, a portion thereof for fielding a baseball thereon;

at least one finger stall attached within said outside shell of said glove/mitt for receipt therein of at least one finger of a hand of a user of said glove/mitt;

and an electrically conductive member for heating said at least one finger stall.

14. A baseball catching glove/mitt as recited in claim 13, further comprising:

said outside shell comprising a front shell for fielding a baseball thereon having an edge and a back shell having and edge and being joined to said front sell along select portions of said edges in such a manner as to form a finger portion and a thumb portion of said catching glove/mitt, and further defining an opening between said front and back shells for receiving therethrough a hand of a user of said catching glove/mitt;

a web-type panel disposed partially between said finger portion and said thumb portion;

at least one interior member located between an inner surface of said front shell and an inner surface of said back shell; and said at least one finger stall extending from said interior member between said interior member and said back shell having a top surface proximate said inner surface of said back shell;

wherein said electrically conductive member is attached along at least a portion of said top surface of said at least one finger stall between said top surface of said at least one finger stall and said inner surface of said back shell.

15. A baseball glove/mitt as recited in claim 14, wherein said front and back shells are substantially joined along select peripheral sections of said front and back shells.

16. A baseball glove/mitt as recited in claim 15, wherein said front and back shells are further substantially joined through select intermediary sections of said front and back shells.

17. A baseball glove/mitt as recited in claim 14, further comprising a power source attached to an outer surface of said back shell.

18. A baseball glove/mitt as recited in claim 17, said power source comprising a battery.

19. A baseball glove/mitt as recited in claim 18, said battery being selectively, removably secured to said outer surface of said back shell in a selectively openable compartment.

20. A baseball glove/mitt as recited in claim 17, said back shell further comprising a strap located proximate said hand receiving opening.

21. A baseball glove/mitt as recited in claim 20, said strap comprising first and second portions having inner and outer surfaces, said inner surface of said first portion closest to said user's hand when said hand is within said opening and said outer surface of said first portion proximate said inner surface of said second portion when said second portion is in a closed position.

22. A baseball glove/mitt as recited in claim 21, further comprising an on/off switch mechanism for said electrically conductive member attached between said electrically conductive member and said power source.

23. A baseball glove/mitt as recited in claim 22, said on/off switch mechanism attached to said glove/mitt between said first and second portions of said strap.

24. A baseball glove/mitt as recited in claim 23, wherein a first end of said second portion of said strap is pivotally secured to a portion of said outer surface of said back shell and a second end of said second portion of said strap releasably securable to another portion of said outer surface of said back shell for easy accessibility to said on/off switch mechanism.

25. A baseball glove/mitt as recited in claim 23, wherein said first and second portions of said strap are a single, unitary length of strap, a first end thereof fixedly attached to said back shell at a first portion of said back shell located on a first side of said opening and a second end thereof received through a receptacle located at a second portion of said back shell on a second, opposite side of said opening, said second end of said unitary length of strap being releasably securable at said first portion of said back shell.

* * * * *